United States Patent [19]

Kurbikoff

[11] 4,240,686

[45] Dec. 23, 1980

[54] TRIPLEX RECEPTACLE

[75] Inventor: Peter A. Kurbikoff, Agoura, Calif.

[73] Assignee: General Signal Corporation, Stamford, Conn.

[21] Appl. No.: 27,922

[22] Filed: Apr. 6, 1979

[51] Int. Cl.[3] ..... H01R 4/66

[52] U.S. Cl. ..... 339/14 R; 339/157 R; 339/184 M; 339/192 R

[58] Field of Search ..... 339/14 R, 156 R, 157 R, 339/184 R, 184 M, 191 R, 191 M, 192 R

[56] References Cited

U.S. PATENT DOCUMENTS

| | | | |
|---|---|---|---|
| 3,310,770 | 3/1967 | Ramsing | 339/14 R |
| 3,327,277 | 6/1967 | Ramsing | 339/14 R |

*Primary Examiner*—Richard B. Lazarus

*Assistant Examiner*—DeWalden W. Jones

*Attorney, Agent, or Firm*—Blakely, Sokoloff, Taylor & Zafman

[57] ABSTRACT

A receptacle for receiving three plugs with ground prongs is disclosed. The blade receiving openings in the cover plate are arranged in two parallel lines with the ground prong receiving openings disposed along the center line of the cover plate. A non-conductive body member includes cavities for receiving ground prong contacts. These contacts extend from a grounding strap which is secured between the upper surface of the body member and the cover plate. The blades of plugs pass through the grounding strap into engagement with underlying contact assemblies which are secured within the body member.

10 Claims, 9 Drawing Figures

TRIPLEX RECEPTACLE

BACKGROUND OF THE INVENTION

1. Field of the Invention

The invention relates to the field of electrical receptacles.

2. Prior Art

The most commonly employed electrical receptacle, particularly for home use, is the duplex receptacle. For some applications, it is of benefit to have a triplex receptacle installed in a standard (single-gang) outlet box.

Triplex receptacles are known, particularly those where all the blade-receiving openings are parallel to one another and with the openings for receiving the ground prongs disposed along one edge of the receptacle. One such triplex receptacle is shown in U.S. Pat. No. 3,327,277.

In some cases, it is desirable to have the openings for the plugs oriented differently than is shown in the above-referenced patent. Specifically, instead of having all the blades receiving openings in side-by-side relationship to one another, in the presently described triplex receptacle the blade-receiving openings form two parallel lines with the ground prong openings disposed along the center line of the receptacle. The invented receptacle permits this orientation in a compact, easy to assemble form. In the past, such orientation of the openings in a triplex receptacle has required the use of a shutter system to prevent the insertion of a plug which did not include a ground prong. This shutter system was necessary to obtain Underwriter's Laboratory's (UL) approval.

SUMMARY OF THE INVENTION

A triplex receptacle is disclosed wherein the blade receiving openings of the cover plate are formed in two parallel lines with the ground prong openings disposed generally centrally along the receptacle. A non-conductive body member defines three aligned cavities. A grounding strap which engages the upper surface of this body member includes three openings disposed above the cavities and three ground prong contacts in electrical contact with the strap extending into each of the openings. Integral mounting ears are formed with the grounding strap. The non-conductive cover plate is secured to the upper surface of the grounding strap. A pair of contact members, each of which includes three sets of contacts integrally formed with a conductive strip, are disposed in the body member with the strips generally parallel to the lines of the prong openings. Thus, insertion of a plug into the openings allows the ground prong to extend into one of the cavities and the blades to engage each of the contact members.

DETAILED DESCRIPTION OF THE INVENTION

A triplex receptacle suitable for mounting in a standard, single-gang electrical receptacle box is described. The receptacle is adaptable for receiving three standard plugs, each of which includes two blades and a ground prong. As is best shown in FIGS. 1 and 2, the openings **23*a* and 23*b* for receiving the blades define a pair of parallel lines; the openings 21** for receiving the ground prongs are centrally disposed along the length of the receptacle.

Figure 1:
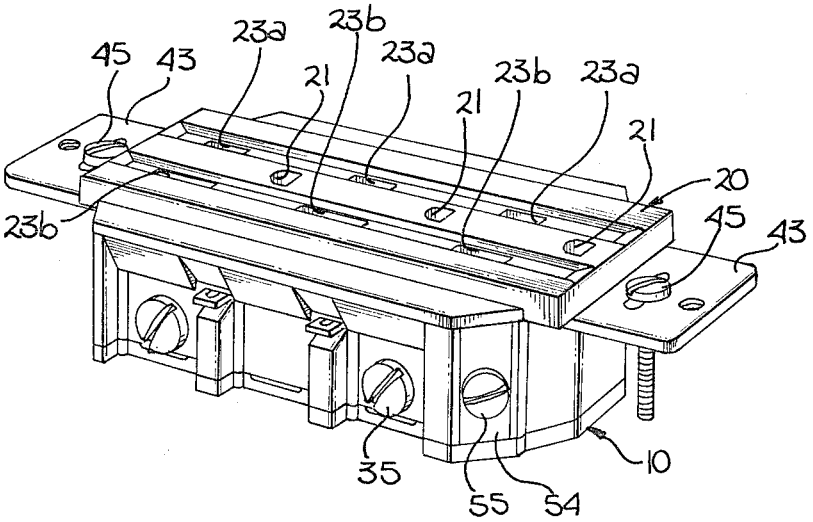
FIG. 1 is a perspective view illustrating the invented triplex receptacle.
Figure 2:
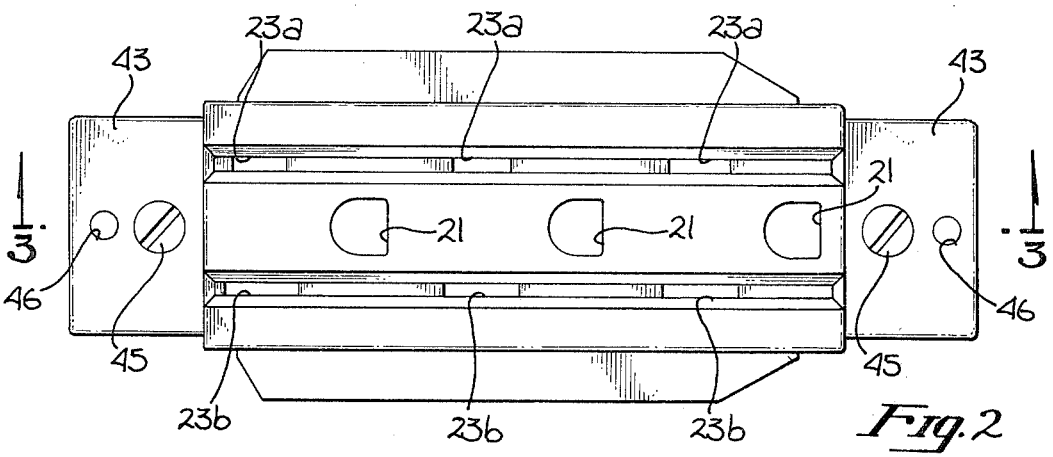
FIG. 2 is a plan view of the receptacle of FIG. 1.
Figure 3:
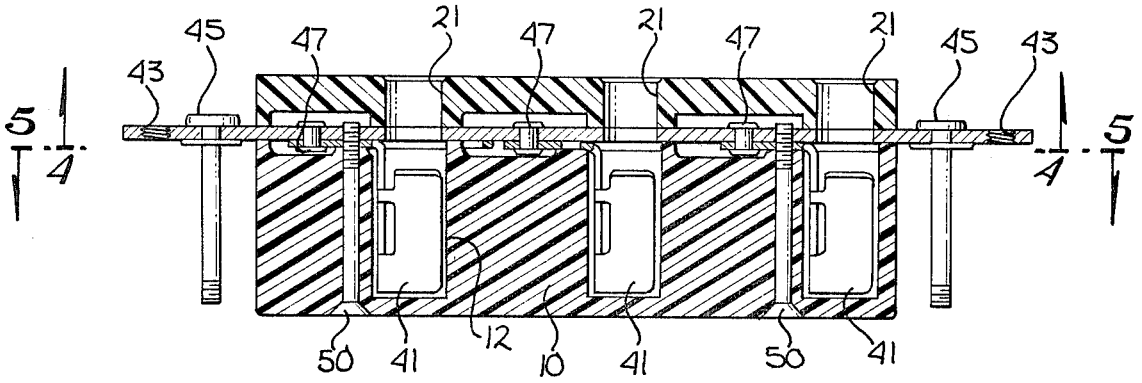
FIG. 3 is a cross-sectional elevation view of the receptacle of FIG. 2 taken generally through section line 3—3 of FIG. 2.
Figure 4:
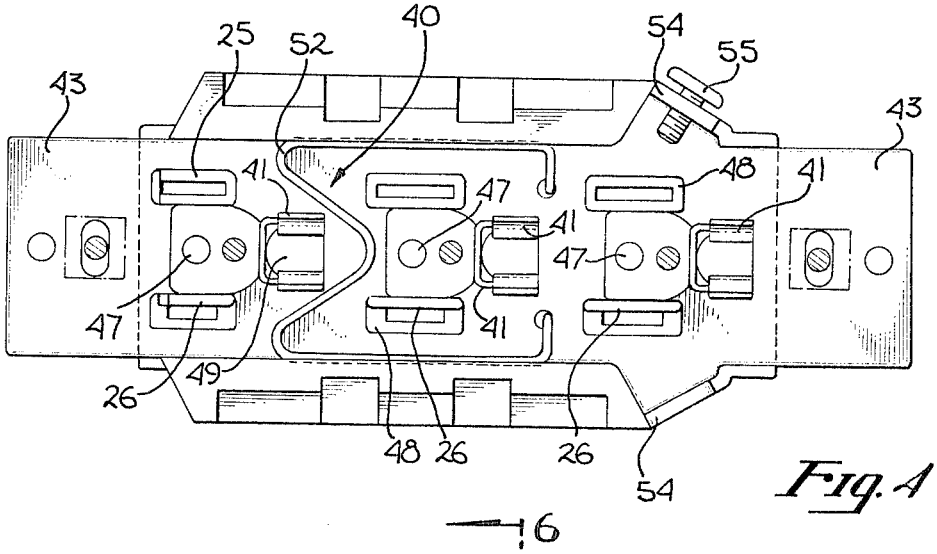
FIG. 4 is a cross-sectional plan view of the underside of the grounding strap taken generally through section line 4—4 of FIG. 3.
Figure 5:
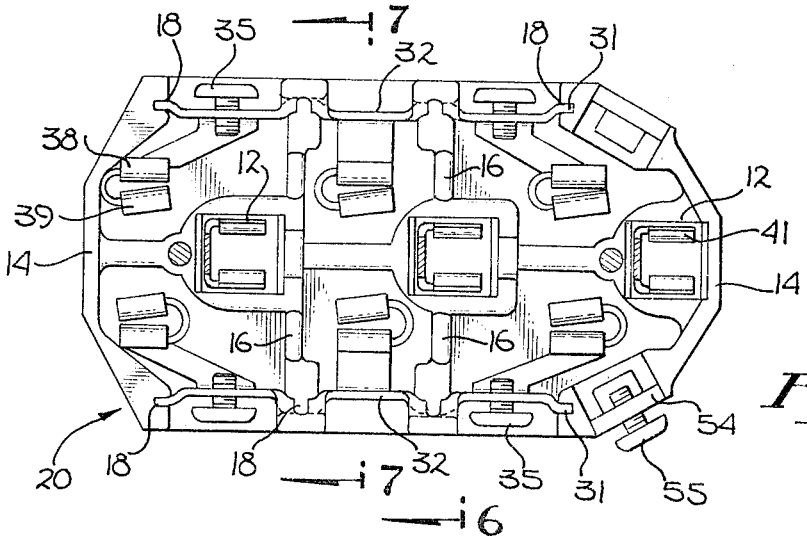
FIG. 5 is a cross-sectional plan view of the receptacle taken generally through section lines 5—5 of FIG. 3.
Figure 9:
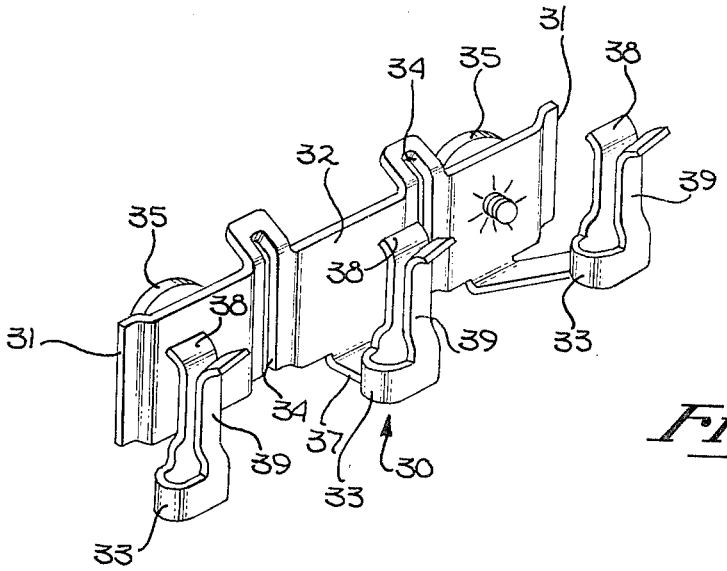
FIG. 9 is a perspective view of one of the contact members employed in the invented receptacle.

The major components of the invented triplex receptacle include a non-conductive body member 10, shown well in FIGS. 1, 3 and 5, and a cover plate 20, shown in FIGS. 1 and 2. A grounding strap 40, shown best in FIGS. 3 and 4, is disposed between the cover plate 20 and body member 10. A pair of contact members 30, best illustrated in FIG. 9, are secured within the body member 10 and provide conductive paths to supply power to plugs engaging the receptacle. The cover plate 20 is secured to the grounding strap 40 by a spring 52, as will be described and as shown in FIG. 4; the grounding strap is secured to the body member 10 through a pair of screws 50 (FIG. 3).

Figure 8:
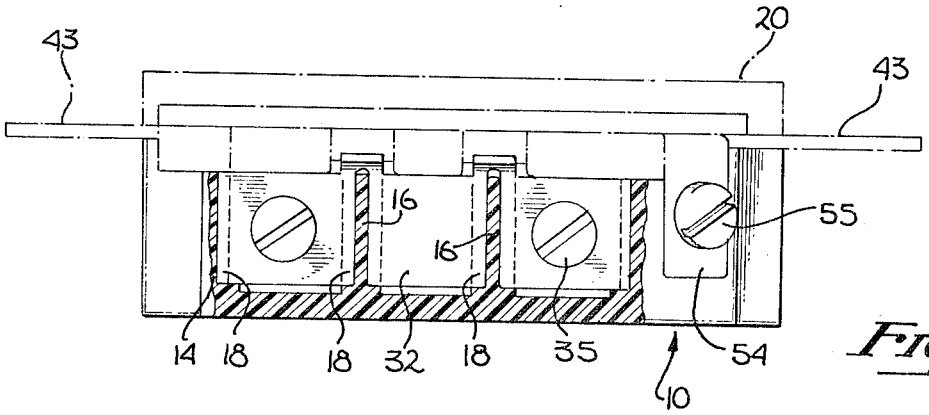
FIG. 8 is an elevation view of the receptacle of FIGS. 1–7 with a portion of the body member cutaway to reveal a contact member.

Referring to FIG. 5, the body member 20 in the presently preferred embodiment is an injection-molded plastic member. This member defines three centrally disposed cavities 12 into which ground prongs extend. The outer edges of the body member 20 include the end walls 14 and two intermediate walls 16. As best illustrated in FIG. 8, the ends of the intermediate walls 16 include grooves 18 which, as will be described, cooperatively engage slots on the contact members. Also, the inner faces of the end walls 14 also include grooves 18, again for receiving the contact members. These latter grooves are also shown in FIG. 5.

The grounding strap 40 is a generally rectangular metal plate mounted between the upper surface of the body member 10 and the underside of the cover plate 20. The grounding strap 40 extends beyond the opposite ends of the receptacle to define mounting ears 43, best shown in FIG. 2. Self-grounding screws 45 for engaging an electrical box are disposed within the mounting ears 43 in a known manner. The grounding strap also includes threaded apertures 46 for attaching a wall plate or similar plate to the receptacle. As best illustrated in FIG. 3, three ground prong contacts 41 are secured in electrical contact with the grounding strap 40. In the presently preferred embodiment, the contacts 41 are riveted by rivets 47 to the strap 40. The contacts 41, which receive the grounding prongs of a plug, extend into the cavities 12 of the body member 10. The strap 40 also includes a pair of integral tabs 54 (FIGS. 1 and 8) which are generally transverse to the strap and which engage slots defined in the exterior of the body member 10. One of these tabs receives a grounding screw 55 to allow separate grounding through a "green" grounding lead. As best illustrated in FIG. 4, the grounding strap 40 includes the openings 48, permitting the blades of a plug to freely pass through the grounding strap, and openings 49 which allow the ground prongs to pass through the strap and into engagement with the underlying contacts 41.

The cover plate 20, as previously described, includes openings allowing the blades and prongs of three plugs to freely pass therethrough. This injection-molded plastic (non-conductive) member has integral sleeves 25 (FIG. 4) which extend from the underside of the cover plate through three of the apertures 48 of the grounding strap 40. These sleeves present the "neutral" blades from contacting the strap 40 when the blades are inserted into the receptacle. The cover 20 also defines the tabs 47 which extend through the other three openings 48 to prevent the power carrying blades from contacting the grounding strap. The underside of the cover plate 20 includes grooves which cooperatively receive the spring 52, as illustrated in FIG. 4, thereby securing the cover plate to the grounding strap.

Referring now to FIG. 9, each contact member 30 is a stamped metal member which defines three pressure contacts extending from the strip 32 on arms 37. Each contact includes a portion 38 which extends generally upright from an arm 37 and a second portion 38 urged toward the first portion by a yoke 33. The contact member defines slots 34 which engage the grooves 18 of the body member 10. The ends 31 of the contact member engage grooves 18, as best illustrated in FIG. 5. Screws 35 cooperatively engage threads in contact member 30 to allow a wire (conductor) to be secured to the member.

Figure 6:
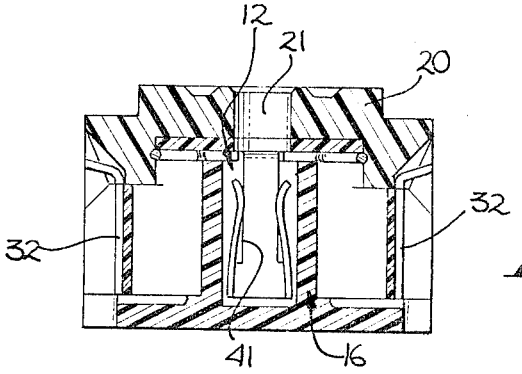
FIG. 6 is a cross-sectional end view of the receptacle taken generally through section line 6—6 of FIG. 5.
Figure 7:
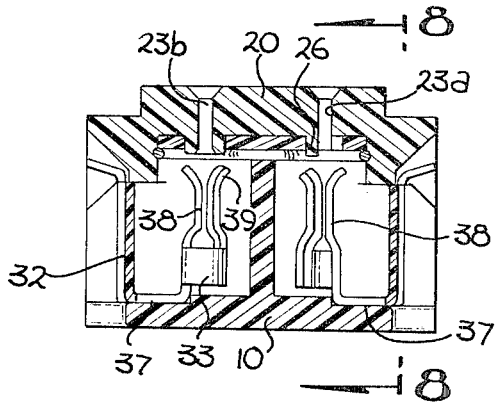
FIG. 7 is a cross-sectional end view of the receptacle taken generally through section line 7—7 of FIG. 5.

When assembled, a pair of contact members 30 are inserted into the body member and held therein as the grooves 18 of the body member are engaged (FIG. 5). When inserted into the body member, the contacts are disposed below the openings 48 of the grounding strap and below the blade receiving openings 23*a* and 23*b* of the cover plate 20. Thus, when a plug is inserted into the openings of the cover plate, the grounding prong engages the contacts 41 (FIG. 6) while the blades engage the contacts of the contact members 30 (FIG. 7).

Thus, a triplex receptacle has been disclosed wherein the blade receiving openings form two parallel lines with the ground receiving openings centrally disposed. This compact, easy-to-assemble receptacle has been found to be acceptable under Underwriter's Laboratory (UL) standards.

I claim:

1. A triplex receptacle comprising:

a non-conductive body member defining three centrally disposed cavities;

a grounding strap engaging the upper surface of said body member, said strap including three openings disposed above said cavities and three ground prong contacts in electrical contact with said strap, each extending into one of said cavities, said strap including integral mounting ears extending beyond opposite edges of said body;

a non-conductive cover plate engaging the upper surface of said grounding strap, said plate including three ground prong openings disposed above said cavities and in alignment with said ground prong contacts and three pairs of blade openings, each pair associated with one of said ground prong openings, said blade openings being disposed along two parallel lines, one on each side of said ground prong openings;

a pair of contact members, each including three sets of contacts integrally formed with a conductive strip and power connection means for allowing power to be coupled to said strip, each of said contact members disposed in said body member such that said strip is generally parallel to the line of said aligned cavities, each set of said contacts being disposed below one of said blade openings;

whereby a compact triplex receptacle is realized.

2. The receptacle defined by claim 1 wherein each set of contacts of said contact members comprises a first portion extending generally parallel to said strip and spaced-apart from said strip by an arm and a second portion generally parallel to said first portion said second portion urged toward said first portion by an integrally formed yoke.

3. The receptacle defined by claim 2 wherein each of said strips of said contact members includes a pair of spaced-apart parallel slots which cooperatively engage grooves in said body member to retain said contact members in said body member.

4. The receptacle defined by claim 3 wherein said power connection means of said contact member comprises screws threaded into said strips for retaining wires.

5. The receptacle defined by claim 1 wherein said grounding strip includes a pair of tabs, generally transverse to said strip for extending along said body.

6. The receptacle defined by claim 5 wherein one of said tabs includes a screw for retaining a grounding wire.

7. The receptacle defined by claim 6 including a spring coupled to said grounding strip for engaging said cover plate to secure said plate to said grounding strip.

8. The receptacle defined by claim 1 wherein said grounding strip includes apertures in alignment with said three pairs of blade openings of said grounding strip such that blades inserted in said opening duly pass through said apertures.

9. The receptacle defined by claim 8 including a sleeve surrounding at least one of said blade openings of said cover plate, said sleeve extending in said aperture to prevent contact between a blade and said grounding strip.

10. The receptacle defined by claim 9 wherein said grounding strip includes a pair of tabs, generally transverse to said strip for extending along said body.

* * * * *